US009511904B2

(12) United States Patent
Futase

(10) Patent No.: US 9,511,904 B2
(45) Date of Patent: Dec. 6, 2016

(54) PACKAGE BAG, PACKAGE BODY USING THE SAME, AND METHOD OF MANUFACTURING SAID PACKAGE BAG

(71) Applicant: YUSHIN CO., LTD., Niigata (JP)

(72) Inventor: Katsunori Futase, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 0 days.

(21) Appl. No.: 14/237,700

(22) PCT Filed: May 15, 2013

(86) PCT No.: PCT/JP2013/063527
§ 371 (c)(1),
(2) Date: Feb. 7, 2014

(87) PCT Pub. No.: WO2014/006981
PCT Pub. Date: Jan. 9, 2014

(65) Prior Publication Data

US 2014/0217119 A1 Aug. 7, 2014

(30) Foreign Application Priority Data

Jul. 3, 2012 (JP) ..... 2012-149018

(51) Int. Cl.
*B65D 35/00* (2006.01)
*B65D 25/42* (2006.01)
(Continued)

(52) U.S. Cl.
CPC ..... *B65D 25/42* (2013.01); *B65B 7/02* (2013.01); *B65B 31/00* (2013.01); *B65D 75/008* (2013.01); *B65D 75/48* (2013.01); *B65D 75/58* (2013.01);
(Continued)

(58) Field of Classification Search
CPC ..... B65D 75/5866; B65D 75/5883
USPC ..... 222/107, 527, 529, 572, 541.6, 491, 222/494; 383/906, 43, 49
See application file for complete search history.

(56) References Cited

U.S. PATENT DOCUMENTS 5,378,065 A 1/1995 Tobolka

FOREIGN PATENT DOCUMENTS

JP 2000-500721 1/2000
JP 2004-338753 12/2004
(Continued)

OTHER PUBLICATIONS

Machine Translation of JP2010260614, 41 pgs.*
(Continued)

*Primary Examiner* — Patrick M Buechner
(74) *Attorney, Agent, or Firm* — Greenblum & Bernstein, P.L.C.

(57) ABSTRACT

A package bag having: a flexible main package bag body formed by fusion-joining a sealant layer of a packaging film of laminated structure including a base film layer and the sealant layer; and a one-way pouring nozzle having a self-sealing function, which is constructed by a planar laminated film having thin thickness including sealant layers on front-back both sides. The one-way pouring nozzle is projected laterally from the flexible main package bag body by fusion-joining a base end portion of the one-way pouring nozzle to an inner surface of a side portion of the main package bag body, including: a projection portion extending continuously from the flexible main package bag body, with which whole one-way pouring nozzle is covered from both of front surface side and a back surface side; and a tear-inducing flaw extending across a center portion in a projection direction of the one-way pouring nozzle.

12 Claims, 13 Drawing Sheets

(51) Int. Cl.

| | |
|---|---|
| ***B65D 75/48*** | (2006.01) |
| ***B65D 75/58*** | (2006.01) |
| ***B65D 75/00*** | (2006.01) |
| ***B65D 85/72*** | (2006.01) |
| ***B65B 31/00*** | (2006.01) |
| ***B65B 7/02*** | (2006.01) |

(52) U.S. Cl.
CPC ..... *B65D 75/5811* (2013.01); *B65D 75/5822* (2013.01); *B65D 75/5866* (2013.01); *B65D 85/72* (2013.01)

(56) References Cited

FOREIGN PATENT DOCUMENTS

| | | |
|---|---|---|
| JP | 2005-15029 | 1/2005 |
| JP | 2005-59958 | 3/2005 |
| JP | 2007-76696 | 3/2007 |
| JP | 2008-055739 | 3/2008 |
| JP | 2010-260614 | 11/2010 |
| JP | 2011-031961 | 2/2011 |
| JP | 4809490 | 8/2011 |
| JP | 2012-046212 | 3/2012 |
| JP | 2012-081983 | 4/2012 |
| WO | 99/54217 | 10/1999 |
| WO | 2004/101365 | 11/2004 |
| WO | 2011/016573 | 2/2011 |
| WO | 2011/071173 | 6/2011 |

OTHER PUBLICATIONS

Machine Translation of JP2012081983, 17 pgs.*
China Office action, mail date is Nov. 3, 2014.
IPRP PCT/JP2013/063527 with English language translation, Jan. 6, 2015.
International Search Report dated Aug. 6, 2013 with English language translation.
Search Report issued by E.P.O. patent office in E.P.O. Patent Application No. 13813459.8, dated Nov. 20, 2015.

* cited by examiner (a)

(b)

PACKAGE BAG, PACKAGE BODY USING THE SAME, AND METHOD OF MANUFACTURING SAID PACKAGE BAG

TECHNICAL FIELD

The present invention relates to a package bag having a self-sealing function, wherein a one-way pouring nozzle for preventing an unexpected air penetration into a flexible main package bag body is arranged in such a manner that it is projected to a side of the main package bag body, a package body in which a liquid material to be packaged is filled and packaged, and a method of manufacturing the package bag.

Especially, the present invention, whether the package body has a self-standing property and a fixed-form property or not, proposes techniques in the case of handling the package body in which the material to be packaged is filled and packaged: which can effectively prevent a generation of unintended torn-opening of the one-way pouring nozzle due to a catch to and an influence with the other members of the one-way pouring nozzle projected from the main package bag body; which can make easy an external exposure of the one-way pouring nozzle at a required position and maintain the one-way pouring nozzle in a sufficiently hygienic state till exposing externally; and which can effectively prevent a permanent deformation such as bend, bulge and so on of the one-way pouring nozzle.

BACKGROUND ART

In patent documents 1 and 2, there is disclosed the one-way pouring nozzle having a self-sealing function which can prevent an unintended air penetration into the flexible main package bag body, at every time before, during and after pouring of the material to be packaged, without regarding a time before and after forming of the tom-opening to the one-way pouring nozzle, in the case of pouring the material to be packaged from the package body, in which the material to be packaged in a liquid form or in a viscous form sometimes including powdery material, granular material and so on is filled and packaged in the package bag.

The one-way pouring nozzle disclosed in these patent documents is formed, by overlapping both ends of one folded thin and planar laminated film or by overlapping two thin and planar laminated films, each having sealant layers on both front and back surfaces and, by fusion-joining a peripheral portion of a formed pouring path without joining a base end side. This one-way pouring nozzle can pour a suitable amount of the liquid material to be packaged in the flexible main package bag body on the basis of a crush deformation and so on of the main package bag body by torn-removing a fusion-joined portion of a tip portion and opening the pouring path. At the same time, this one-way pouring nozzle can function to prevent an air penetration into the main package bag body by closing tightly an inner surface of the pouring path of the one-way pouring nozzle immediately under an existence of thin film of the material to be packaged due to a wetting on the basis of a capillary phenomenon and so on of the liquid material to be packaged, in the case of stopping a pouring based on a standing deformation of the main package bag body.

By the way, in the case of performing a subsequent pouring operation of the material to be packaged in the bag, the flexible main package bag body is tilted to direct the one-way pouring nozzle downward, so that the pouring path of the pouring nozzle is opened through the action of hydraulic head pressure and so on of the liquid material to be packaged, and the material to be packaged in the bag can be poured according to need.

Therefore, according to the package body comprising the one-way nozzle disclosed in the patent documents 1 and 2, the air penetration into the package bag can be sufficiently prevented at all times by sealing the package bag under degassing through in-liquid seal-packing and so on, and oxidation, pollution, putrefaction and so on of the material to be packaged in the bag can be surely prevented over the long term.

Patent Document 1: Japanese Patent Laid-Open Publication No. 2005-15029

Patent Document 2: Japanese Patent Laid-Open Publication No. 2005-59958

SUMMARY OF THE INVENTION

Task to be Solved by the Invention

In the package body wherein the liquid material to be packaged is filled through an upper opening or a lower opening of the main package bag body equipped in the package bag comprising the one-way pouring nozzle disclosed in the patent documents 1 and 2 and the opening is sealed laterally under degassing atmosphere, the one-way pouring nozzle 21 is projected laterally from the upper end of the flexible main package bag body 22 as shown in FIG. 8. In the package body 23 mentioned above, there are fears of deteriorating a self-sealing function because the unintended tom-opening is generated at a tip portion of the one-way pouring nozzle 21 due to a catch to and an influence with the other members of the one-way pouring nozzle 21 projected from the main package bag body and the one-way pouring nozzle 21 formed by fusion-joining the thin and planar laminated film is bent or deformed permanently due to a box packing operation and so on of the package body 23.

On the other hand, if the package body 23 is accommodated together with a portion of the one-way pouring nozzle 21 in a dispenser and so on made of paper, resin molded body and so on having a stiffness higher than that of the flexible main package bag body 22, it is possible to effectively prevent an unintended tom-opening of the one-way pouring nozzle 21, a breakage of the one-way pouring nozzle 21 due to a lamination of the package bodies and so on, a permanent deformation of the pouring nozzle 21 due to a box-packing of the package body and so on. However, in this case, there is a problem such that a package cost of the liquid material to be packaged is necessarily increased due to the use of high stiffness dispenser and so on.

The present invention has its object to solve the problems mentioned above and to provide: a package bag, which can sufficiently eliminate a possibility of unintended tom-opening of the one-way pouring nozzle without using an accommodation dispenser, and so on, having a high stiffness causing an increase of packaging cost, and, which can effectively prevent a generation of permanent deformation toward the one-way pouring nozzle, and so on; a package body using the same; and a method of manufacturing the package bag mentioned above.

Solution for Task

A package bag according to the invention is a package bag having: a flexible main package bag body formed by fusion-joining a sealant layer of a packaging film of laminated structure including a base film layer and the sealant layer;

and a one-way pouring nozzle having a self-sealing function formed by fusion-joining a portion around a pouring path of in-bag material to be packaged without a base end side, which is constructed by a planar laminated film having thin thickness comprising sealant layers on front-back both sides, wherein the one-way pouring nozzle is projected laterally from an upper portion or a lower portion of the flexible main package bag body by fusion-joining an outer surface of a base end portion of the one-way pouring nozzle to the sealant layer existing on an inner surface of a side portion of the main package bag body, comprising: a projection portion of the packaging film extending continuously from the flexible main package bag body, with which whole one-way pouring nozzle is covered from both of front surface side and a back surface side; and a tear-inducing flaw extending across an intermediate portion along a projection direction of the projection portion from the flexible main package bag body of the one-way pouring nozzle, wherein the main package bag body is made to be opened at either one side of an upper end and a lower end.

As to a preferable solution for task according to the invention, there are following cases such that:

(1) the sealant layers on the opposed inner surfaces of the projection portion of the packaging film are fusion-joined with each other in a width direction of the main package bag body at a vicinity of the one-way pouring nozzle;
(2) a fusion-joining portion of the projection portion of the packaging film extending in a width direction of the main package bag body is formed continuously to a traverse seal portion at the upper end portion or the lower end portion of the main package bag body;
(3) a fusion-joining portion of the projection portion of the packaging film extending in a width direction of the main package bag body is formed on an extended line of a fused portion extending parallel to the upper end portion or the lower end portion of the main package bag body;
(4) the sealant layers on the opposed inner surfaces of the packaging film are fusion-joined with each other in an up-and-down direction of the main package bag body at a free end portion of the projection portion of the packaging film;
(5) the tear-inducing flaw is formed at a position crossing a center portion in a projection direction of the one-way pouring nozzle;
(6) the tear-inducing flaw is formed in a linear shape or a curved shape at its overlapping region with the one-way pouring nozzle;
(7) a reinforcing seal portion, which includes a region of the lower end of the main package bag body corresponding to the base end portion of the one-way pouring nozzle, and, which projects toward a storage space of the material to be packaged, is arranged to the inner surface of the main package bag body to which the base end portion of the one-way pouring nozzle is fusion-joined;
(8) a planar contour shape of the reinforcing seal portion is circular shape, ellipse shape, oval shape or polygonal shape;
(9) at least corner portion of the reinforcing seal portion having polygonal shape as its planar contour shape, which exists at an upper end side of the package bag, is a convex curved shape projecting outward; and
(10) a tentative fused portion for completely closing the pouring path is arranged at the inner surface of the base end portion of the one-way pouring nozzle.

Moreover, the present invention proposes a package body, wherein a liquid material to be packaged is filled from the upper opening of the package bag mentioned above, the upper end portion or the lower end portion is sealed in a lateral direction under no gaseous atmosphere, and the thus formed lateral sealing portion is extended along whole projection portion of the packaging film.

In this case, the package body according to the invention can be made in a three-side sealing type, four-side sealing type and so on. Moreover, it is possible to arrange a self-standing bottom portion thereto.

Further, the present invention proposes a method of manufacturing the package bag mentioned above, comprising: feeding a nozzle film, on which a plurality of one-way pouring nozzles are preliminarily formed, with respect to the packaging film to which the tear-inducing flaw is preliminarily formed and which is fed at a predetermined speed; fusion-joining one sealant layer on the outer surfaces of the base end portion of respective one-way pouring nozzles to the sealant layer on the inner surface of the packaging film at a position where the tear-inducing flaw is passed through an intermediate portion of the one-way pouring nozzle, and, where tips of the one-way pouring nozzles are aligned with a side end of the packaging film or tips of the one-way pouring nozzles are retracted from a side end of the packaging film, when both films are fed at a same speed; detaching an unwanted portion of the nozzle film from the one-way pouring nozzle so as to remove it; folding the packaging film in half at a center portion of its width direction; and fusion-joining the sealant layer at a folded side of the packaging film to the other sealant layer on the outer surface of the base end portion of the one-way pouring nozzle and the packaging film opposed to an extension of the base end portion of the one-way pouring nozzle, respectively in a longitudinal direction so as to form the package bag and in a lateral direction at a position opposed to whichever one of the lower end portion and the upper end portion of the package bag to be manufactured, so that the one-way pouring nozzle projected sideward from the main package bag body is covered at both sides of front and back surfaces at the projection portion of the packaging film continued from the main package bag body.

Effect of the Invention

In the package bag according to the invention, the one-way pouring nozzle projected sideward from the flexible main package bag body is covered from both front and back sides by the projection portion made of the packaging film arranged continuously to the main package bag body, and thus it is possible to prevent an outward exposure of the one-way pouring nozzle.

Therefore, in the package body in which the material to be packaged is filled and packaged into the package bag, since the catch to and the influence with the other members of the one-way pouring nozzle, and so on, can be effectively prevented at the projection portion of the packaging film, it is possible to sufficiently eliminate a possibility of unintended torn-opening of the one-way pouring nozzle without accommodating in the accommodation dispenser and so on having a high stiffness.

Moreover, in the package bag mentioned above, since the one-way pouring nozzle is covered from both front and back sides by the projection portion of the packaging film, it is possible to hygienically maintain the one-way pouring nozzle until the one-way pouring nozzle is exposed outward by cutting off the projection portion along a formation position of the tear-inducing flaw. Moreover, in the case of box-packing of the package body formed by filling and packaging the material to be packaged into the package bag, it is possible to effectively prevent a permanent deformation due to a breaking or a bending of the one-way pouring nozzle by means of a specific stiffness of the projection portion.

On the other hand, in the case of pouring the liquid material to be packaged from the package bag, the projection portion is torn and removed along the tea-inducing flaw, which is formed at the projection portion of the packaging film, which is extended across the intermediate portion in the projection direction of the one-way pouring nozzle, and which is positioned toward a side of the main package bag body from a planned position for forming a tom-opening of the one-way pouring nozzle. Moreover, the pouring path is opened by tearing and removing the tip fused portion of the one-way pouring nozzle exposed outward, and the package body is tilted in such a manner that the opening is directed downward. Therefore, it is possible to pour the material to be packaged in the bag in a desired manner by opening the pouring path through the action of hydraulic head pressure of the material to be packaged.

In this case, since the flexible main package bag body is crushed and deformed by a volume corresponding to a pouring amount of the material to be packaged, it is possible to effectively prevent the air penetration into the package bag body during the pouring of the material to be packaged.

Then, if the package body is returned to a standing position due to a stop of pouring, the inner surfaces of the pouring path of the one-way pouring nozzle, which are wetted by the liquid material to be packaged, are attached firmly with each other immediately under an existence of thin film of the material to be packaged, in the same manner as that of the pouring nozzle disclosed in the patent documents 1 and 2. Therefore, it is possible to prevent the air penetration into the package body.

Therefore, in the package body mentioned above, the material to be packaged in the bag is surely protected from the air penetration at every time before, during and after pouring of the material to be packaged. Consequently, it is possible to effectively remove the possibilities of oxidation, pollution and putrefaction of the material to be packaged.

In the package body, a remnant of the projection portion of the packaging film existing at a side of the flexible main package bag body from the position forming the tear-inducing flaw functions to sandwich the one-way pouring nozzle till the intermediate portion when the pouring of the material to be packaged is stopped. Therefore, it is possible to rapidly and surely perform a firm attachment of the inner surfaces of the pouring path mentioned above.

Then, in the package bag mentioned above, if the opposed sealant layers on the inner surfaces of the projection portion of the packaging film are fused with each other in a width direction of the flexible main package bag body at a vicinity of the one-way pouring nozzle, the unintended exposure of the one-way pouring nozzle can be prevented more effectively, and the one-way pouring nozzle can be maintained more hygienically. In addition, the permanent deformation due to the bending deformation toward the one-way pouring nozzle can be prevented more effectively.

The function and effect mentioned above are realized in the same manner both in the case that the fusion-joined portion extended in a width direction of the flexible main package bag body is formed continuously to the lateral sealing portion in the lower end portion or the upper end portion of the flexible main package bag body and in the case that the fusion-joined portion mentioned above is formed on the extended line of another fused portion extended in parallel to the lateral sealing portion of the lower end portion and the upper end portion of the flexible main package bag body. In the former case such that the fusion-joined portion is formed in a width direction of the flexible main package bag body connected to the lateral sealing portion, there is a merit such that another step for forming another fusion-joined portion, which is in parallel to the lateral sealing portion, can be eliminated.

Moreover, in the case that the opposed sealant layers on the inner surfaces of the packaging film are fusion-joined with each other in an up-and-down direction of the flexible package bag body at the free end portion of the projection portion, the one-way pouring nozzle can be protected from external as in the case of forming the fusion-joined portion extended in a width direction of the flexible main package bag body. This is more effective if the following former and latter cases are performed together with each other: (former case) the fusion-joined portion extended in a width direction of the flexible main package bag body is formed; and (latter case) the sealant layers are fusion-joined in an up-and-down direction of the flexible main package bag body. In this case, the one-way pouring nozzle is surrounded in a hook shape by the fusion-joined portion.

In the case that the tear-inducing flaw is formed at a position crossing the intermediate portion in a projection direction of the one-way pouring nozzle, if the projection portion of the packaging film (front side portion of the one-way pouring nozzle) is torn and removed at a position forming the tear-inducing flaw, the projection portion remaining at a side of the main package bag body can be kept adequately long. Therefore, a function of sandwiching the pouring path by the projection portion, when the pouring of the material to be packaged is stopped, can be surely ensured.

Here, the reason for limiting "center portion" in the projection direction is as follows. That is, in relation to the projection amount from the main package bag body of the one-way pouring nozzle, if the tear-inducing flaw is passed through a portion existing in a range of ±20% of the projection amount from a position of "center portion" of the projection portion of the packaging film, the self-sealing function of the one-way pouring nozzle can be effectively assisted.

Moreover, in the case that the tear-inducing flaw has a linear shape or a curved shape in a region overlapping with the one-way pouring nozzle, it is possible to adequately control the sandwiching condition, the sandwiching strength and so on with respect to the pouring path of the one-way pouring nozzle according to the requirements, and also it is possible to assist the self-sealing function of the one-way pouring nozzle according to the requirements.

In this case, if a shape of the tear-inducing flaw is either one of them, in the projection portion of the packaging film, a front side portion of the tear-inducing flaw (tip side of the one-way pouring nozzle) can be easily torn and removed according to the requirements, and thus it is possible to expose the one-way pouring nozzle outward.

In the case that the tear-inducing flaw is formed by means of a perforation hole penetrating in its thickness direction in the projection portion of the packaging film, the torn and removed processing along the tear-inducing flaw of the front side portion of the one-way pouring nozzle in the projection portion can be made extremely easy.

On the other hand, in the case that the tear-inducing flaw is formed continuously or intermittently by performing a laser processing etc. with respect to the base film layer of the packaging film so as to form grooves which do not reach to the sealant layer, even if a barrier layer and so on is formed between the base film layer and the sealant layer, a contact of the one-way pouring nozzle with air can be surely prevented while the functions can be maintained as they are, so that the material to be packaged, which is for example drugs and medicines, can be protected more effectively.

Here, in the case that the reinforcing seal portion, which includes a region of the lower end side of the main package bag body corresponding to the base end portion of the one-way pouring nozzle, and, which projects toward a storage space of the material to be packaged, is arranged to the inner surface of the flexible main package bag body to which the base end portion of the one-way pouring nozzle formed by the thin and planar laminated film is fusion-joined, a stress concentration of the base end portion of the one-way pouring nozzle corresponding to the fusion-joined portion to the main package bag body can be effectively reduced by the reinforcing seal portion, and a stress concentration of the one-way pouring nozzle to the fusion-joined portion around the pouring path can be reduced. In this case, in the case that the package bodies in which the material to be packaged is filled and packaged are stacked, a generation of the unintended breakage to the package body can be effectively prevented.

Then, in the case that the planar contour shape of the reinforcing seal portion is ellipse shape, circular shape, oval shape or polygonal shape, whatever the planar contour shape is chosen, it is possible to sufficiently realize the desired reinforcing function to the reinforcing seal portion.

Moreover, since the reinforcing seal portion has an effect for preventing too much opening of the pouring path of the one-way pouring nozzle i.e. the pouring path opening, it is possible to sufficiently prevent the unintended detachment of the fusion-joined portion of the one-way pouring nozzle.

Further, in the case that the planar contour shape of the reinforcing seal portion is made to the polygonal shape and at least corner portion of an upper end side of the package bag is made to be a convex curved shape projecting outward, a flow of the material to be packaged, pouring into the pouring path of the one-way pouring nozzle from a side of the flexible main package bag body, can be regulated, and thus it is possible to achieve a uniformizing of a pouring amount in the same manner as that of the reinforcing seal portion having the contour shape of circular, ellipse, oval and so on.

By the way, since the reinforcing seal portion is formed in such a manner that it includes the fusion-joined portion between the flexible main package bag body and the base end portion of the one-way pouring nozzle, a nerve of the base end portion of the one-way pouring nozzle formed by the thin and planar laminated film becomes stronger to the same level as that of the flexible main package bag body, and thus the base end portion of the one-way pouring nozzle is not folded or bent. Therefore, it is possible to sufficiently maintain the pouring performance of the one-way pouring nozzle.

Furthermore, in the case that the tentative fused portion for completely closing the pouring path is arranged at the inner surface of the base end portion of the one-way pouring nozzle, it is possible to prevent a flow of the liquid material to be packaged, which is subjected to a high-temperature sterilization, into the pouring path of the one-way pouring nozzle by means of the tentative fused portion. And, it is possible to effectively prevent a decrease of the self-sealing function due to the permanent deformation such as a distended deformation of the pouring path. In this case, the tentative fused portion can be formed by making small at least one of heating temperature, applied pressure and heating duration as compared with those of the required fusion-joined portion.

Here, the "base end portion" of the one-way pouring nozzle means not only a position of the base end side of the one-way pouring nozzle corresponding to the fusion-joined portion to the flexible main package bag body but also a position of the tip end side of the one-way pouring nozzle at which the pouring path having a sufficient length for achieving the self-sealing function can be maintained.

Moreover, since the tentative fused portion can exhibit anti-delamination force with respect to the stacking of the package bodies until delaminating non-randomly, it is effectively prevent a breakage of the pouring path and a distended deformation due to a flow of the material to be packaged into the pouring path, and thus it is possible to sufficiently maintain the self-sealing function.

In the case that a fusion strength of the tentative fused portion is not more than a half of the fusion strength around the pouring path of the one-way pouring nozzle, an unintended flow of the material to be packaged into the pouring path can be prevented. In addition, in the case that the tentative fused portion is non-randomly delaminated under for example an action of a pressure force to the package body, it is possible to sufficiently eliminate a possibility of delaminating the fusion-joined portion around the pouring path, and thus a desired function of the one-way pouring nozzle can be realized.

Moreover, in the package body according to the invention, since the liquid material to be packaged is filled from the upper or lower opening of the package bag mentioned above, the opening is sealed in a lateral direction under no gaseous atmosphere through in-liquid seal-packing and so on, and thus formed lateral sealing portion is extended along whole projection portion of the packaging film, it is possible to effectively protect the one-way pouring nozzle projected from the main package bag body. Moreover, the one-way pouring nozzle can be surrounded by the fusion-joined portions arranged at the tip side and the up-and-down side of the projection portion of the packaging film. In this case, the unintended outward exposure of the one-way pouring nozzle can be prevented more sufficiently, and thus it is possible to protect more effectively the one-way pouring nozzle from torn-opening, breakage, folded or bent deformation and so on.

Further, in the method of manufacturing the package bag according to the invention, firstly, the method comprises the steps of feeding a nozzle film, on which a plurality of one-way pouring nozzles are preliminarily formed, from a wound roll toward the packaging film to which the tear-inducing flaw is preliminarily formed, which is fed consecutively at a predetermined speed; and fusion-joining one sealant layer on the outer surfaces of the base end portion of respective one-way pouring nozzles to the sealant layer on the inner surface of the packaging film at a position where the tear-inducing flaw is passed through an intermediate portion of the one-way pouring nozzle, and, where tips of the one-way pouring nozzles are aligned with a side end of the packaging film or tips of the one-way pouring nozzles are retracted from a side end of the packaging film, when both films are fed at a same speed.

Then, the method comprises the steps of: detaching an unwanted portion of the nozzle film from the one-way pouring nozzle so as to remove it; folding the packaging film in half at a center portion of its width direction, wherein the tear-inducing flaw of the half folded portion is passed through the intermediate portion of the one-way pouring nozzle; and fusion-joining the sealant layer at a folded side of the packaging film to the other sealant layer on the outer surface of the base end portion of the one-way pouring nozzle and the packaging film opposed to an extension of the base end portion of the one-way pouring nozzle, respectively in a longitudinal direction so as to form the package bag, and fusion-joining the sealant layer opposed to the inner surface of the packaging film in a lateral direction at a position opposed to whichever one of the lower end portion and the upper end portion of the package bag to be manufactured, so that the one-way pouring nozzle projected sideward from the flexible main package bag body is covered at both sides of front and back surfaces at the projection portion of the packaging film continued from the main package bag body. Thereby, it is possible to inexpensively manufacture the package bag which can effectively protect the one-way pouring nozzle by sandwiching it by means of the projection portion of the packaging film without preparing the dispenser etc. having a high stiffness.

BEST MODE FOR CARRYING OUT THE INVENTION

Hereinafter, embodiments according to the invention will be explained on the basis of the drawings.

Figure 1:
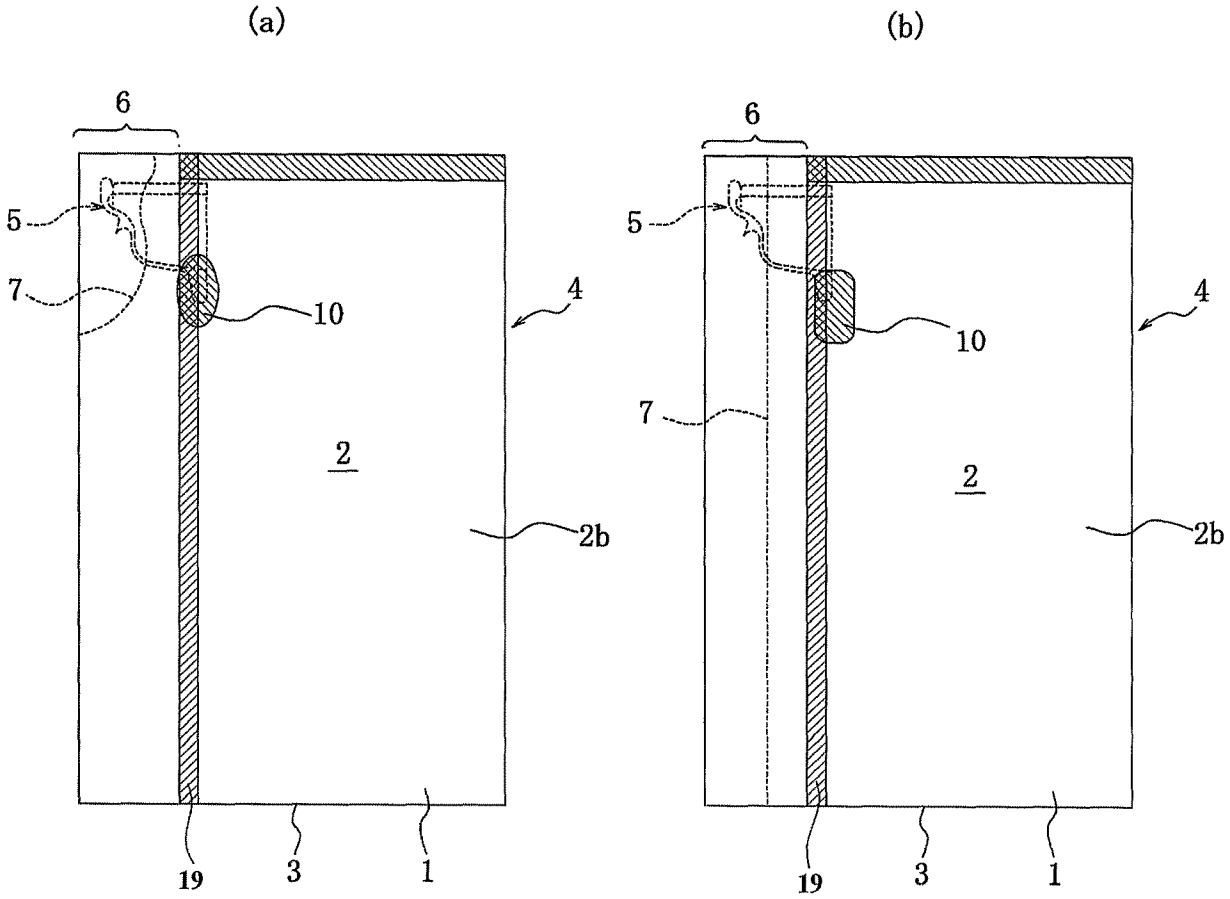
FIG. 1 is a plan view showing one embodiment of the package bag.

The embodiment shown in FIG. 1 illustrates a package bag 4 of two-side sealing type, in which a packaging film 1 formed by a laminated structure having two layers or more than three layers, which comprises a base film layer and a sealant layer, is folded in half at a center portion of its width direction, and, in which a lower opening 3 is formed to a flexible main package bag body 2 wherein the sealant layers on inner surfaces are fusion-joined linearly in every directions of a length direction (longitudinal sealing portion 19) and a width direction (lateral sealing portion 2*a*) as shown by a diagonal line in Figure.

In this case, the packaging film 1 may comprise an intermediate layer, an evaporated layer and so on. Moreover, the packaging film 1 may use the package bag 4, for example, fusion-joined as lateral side sealing type, three-side sealing type and so on other than the two-side sealing type mentioned above.

In the package bag 4, an outer surface of a base end portion of one-way pouring nozzle 5 having a self-sealing function formed by fusion-joining a portion around a pouring path of in-bag material to be packaged without a base end side, which is constructed by one or two thin and planar laminated film(s) comprising the sealant layers on front-back both sides, is fusion-joined to the sealant layer existing on an inner surface of a side portion of the flexible main package bag body 2. Therefore, the one-way pouring nozzle 5 is projected laterally from an upper portion of the flexible main package bag body 2 in Figure.

In this case, the one-way pouring nozzle 5 is formed by fusion-joining the portion around the required pouring path without the base end portion under a state such that one planar laminated film is folded or under a state such that two planar laminated films are overlaid in opposed postures of the sealant layers. In the one-way pouring nozzle 5 mentioned above, a fusing temperature of the sealant layer on an outer surface side is preferably made to a temperature lower than a fusing temperature of the sealant layer on an inner surface side of the one-way pouring nozzle 5. Herewith, in the case that the outer surface of the base end portion of the one-way pouring nozzle 5 is fusion-joined to the inner surface of the side portion of the flexible main package bag body 2 by heat seal, high-frequency seal, impulse seal and so on, it is possible to prevent a fusion-join of an inner surface of the base end portion of the one-way pouring nozzle 5.

Meanwhile, it is preferable that the sealant layer forming the inner surface of the flexible main package bag body 2 is made from the same resin material as the sealant layer forming the outer surface of the one-way pouring nozzle 5, thereby the fusion joining strength of the each portion can be enhanced sufficiently.

The package bag 4 mentioned above has a feature that a projection portion 6 of the packaging film 1 extending continuously to the flexible main package bag body 2, with which whole one-way pouring nozzle 5 is covered from both of front surface side and a back surface side, is arranged. By sandwiching the one-way pouring nozzle 5 between the projection portion 6, outward exposure of the one-way pouring nozzle 5 from the projection portion 6 can be restricted, and thus it is possible to prevent a generation of unintended tom-opening of the one-way pouring nozzle 5, bending deformation of the pouring nozzle and so on.

Further, in the package bag 4, a tear-inducing flaw 7 extending across an intermediate portion along a projection direction of the one-way pouring nozzle 5 is arranged at positions corresponding to respective projection portions 6 on the front and back of the packaging film 1.

Here, the tear-inducing flaw 7 is torn when a liquid material to be packaged, which is filled and packaged in the package bag 4, is poured firstly, and the projection portion 6 on a tip end side of the one-way pouring nozzle 5 is removed from a formation position of the tear-inducing flaw 7, thereby exposing the one-way pouring nozzle 5 outward.

After that, a tip end fusion-joined portion of the one-way pouring nozzle 5 is torn and removed at a formation position of, for example V notch, – notch and so on, and then the pouring path is made to be opened, thereby pouring the material to be packaged according to the requirements.

Meanwhile, the tear-inducing flaw 7 formed corresponding to the projection portion 6 on the front and back respectively is formed by means of a lot of perforation holes penetrating in its thickness direction in the projection portion 6 as shown in FIG. 1. In this case, the tear-inducing flaw 7 is extended in a convex curved shape on the one-way pouring nozzle 5 in FIG. 1*a*, and the tear-inducing flaw 7 is extended in a linear shape on the one-way pouring nozzle 5 in FIG. 1*b*.

A sandwiching force applied to the one-way pouring nozzle 5 from the projection portion 6 of the packaging film 1 can be controlled by selecting passing position, passing configuration and so on of the tear-inducing flaw 7 with respect to the one-way pouring nozzle 5 according to need. Therefore, a contact timing of the pouring path after stopping the pouring of the material to be packaged can be controlled in a desired manner.

Meanwhile, the sandwiching force of the one-way pouring nozzle 5 by means of the projection portion 6 of the packaging film 1 can be made extremely larger, in the case that two fusion-joined portions in a line shape extended in a width direction of the flexible main package bag body 2 are arranged to the projection portion 6 corresponding to the upper-and-lower positions of the one-way pouring nozzle 5, and in the case that a fusion-joined portion extended in a length direction of the flexible main package bag body 2 is arranged to a free end portion of the projection portion 6 corresponding to a position located near the one-way pouring nozzle 5.

Figure 2:
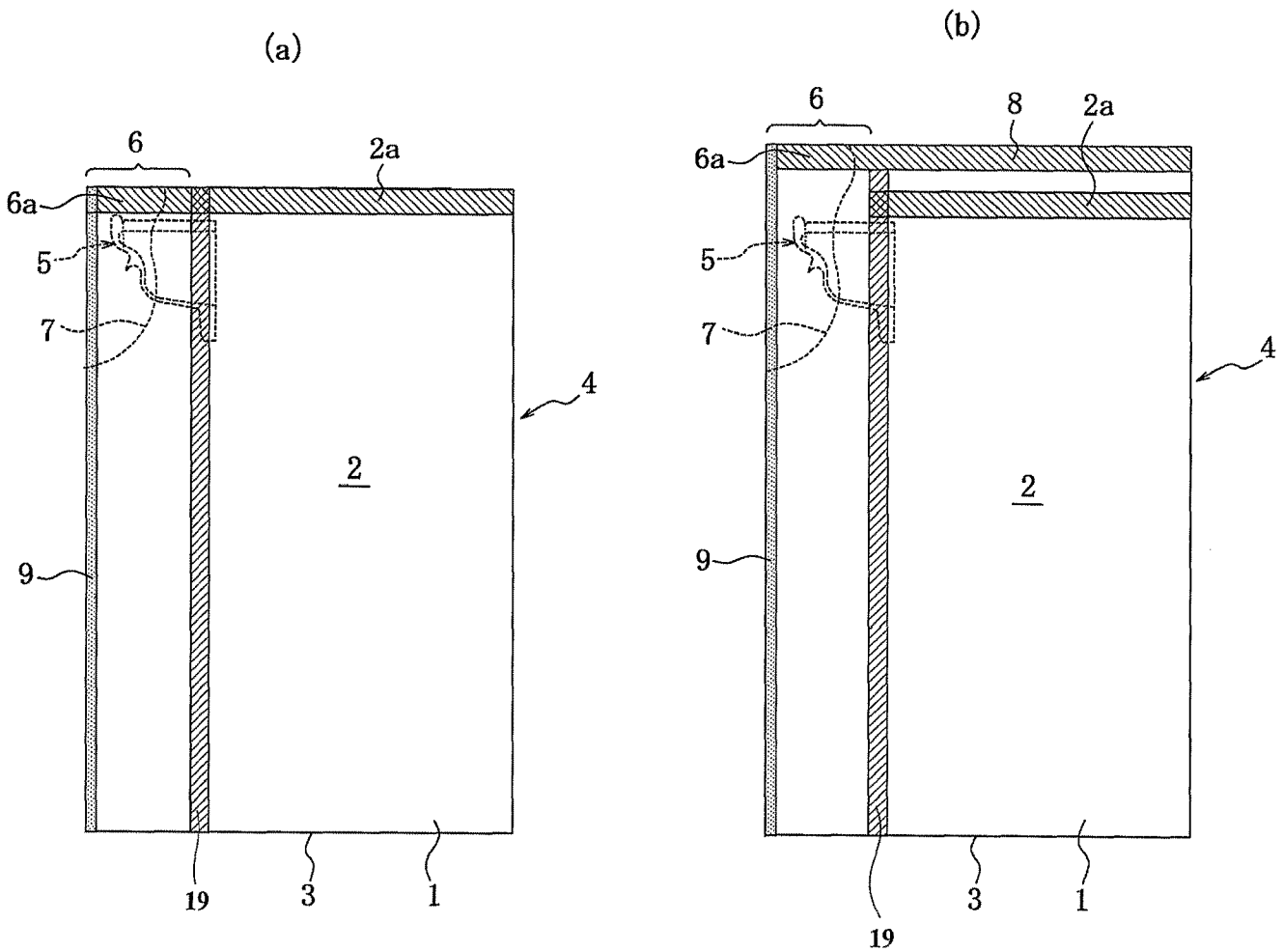
FIG. 2 is a plan view illustrating a fusion-joined example of the projection portion of the packaging film.

FIG. 2 is a plan view explaining a case that the fusion-joined portions of the projection portion 6 of the packaging film 1 are arranged in a width direction and in a length direction of the flexible main package bag body 2 in a vicinity of the one-way pouring nozzle 5. In FIG. 2*a*, a fusion-joined portion 6*a* of the projection portion 6 of the packaging film 1 extending in a width direction of the flexible main package bag body 2 is formed continuously to the lateral sealing portion 2*a* located for example to the upper end portion of the flexible main package bag body 2.

Moreover, in FIG. 2*b*, the fusion-joined portion 6*a* of the projection portion 6 of the packaging film 1 extending in a width direction of the flexible main package bag body 2 is formed on an extended line of a lateral direction fusion-joined portion 8 extended in parallel to the lateral sealing portion 2*a* located for example in the upper end portion of the flexible main package bag body 2.

In the embodiment shown in FIG. 2*a*, there is a merit such that a step of forming the lateral direction fusion-joined portion 8 other than the lateral sealing portion 2*a* extended in parallel to the lateral sealing portion 2*a* can be eliminated.

Then, in the case shown in either one of FIG. 2*a* and FIG. 2*b*, the sealant layer of the packaging film 1 corresponding to the free end portion of the projection portion 6 of the packaging film 1 and located to a position near the one-way pouring nozzle 5 can be fusion-joined in a length direction of the flexible package bag body 2 as shown in dotted region in the figure. If a fusion joined portion 9 extended in a length direction is arranged, it is possible to advantageously prevent the exposure of the one-way pouring nozzle 5 and to effectively protect the one-way pouring nozzle 5 by means of sandwiching the one-way nozzle 5 between the front and back of the projection portion 6.

In addition, as shown in FIG. 1, it is preferable that the tear-inducing flaw 7 is formed at a position crossing a center portion in a projection direction of the one-way pouring nozzle 5. In this case, if the projection portion 6 of the packaging film 1 is torn and removed at the formation position of the tear-inducing flaw 7, a length of the projection portion 6 remaining at a side of the flexible main package bag body 2 can be sufficiently maintained and the pouring path of the one-way pouring nozzle 5 can be sufficiently sandwiched by the remained projection portion 6. Therefore, it is possible to rapidly and surely prevent the unintended air penetration into the flexible main package bag body 2.

Moreover, the tear-inducing flaw 7 shown in FIG. 1 is formed by the perforation holes, which penetrate the projection portion 6 in its thickness direction of the packaging film 1. Therefore, it is possible to tear and remove the projection portion 6 of the packaging film 1 along the tear-inducing flaw 7 in an extremely easy manner. Meanwhile, since the perforation holes penetrate the projection portion 6 in its thickness direction, there is a possibility of penetrating dust and so on from the holes, and thus the penetrated dust is in danger of adhering to the one-way pouring nozzle 5.

On the other hand, in the case that the tear-inducing flaw 7 is formed continuously or intermittently by performing a laser processing with respect to the base film layer of the packaging film 1 so as to form grooves which do not reach to the sealant layer, an increase of a tear resistance of the projection portion 6 along the tear-inducing flaw 7 is necessitated, but it is possible to sufficiently remove a possibility of dust adhesion to the one-way pouring nozzle 5. Therefore, even if the liquid material to be packaged is drugs and medicines and so on, it is possible to maintain the material to be packaged more hygienically.

Figure 3:
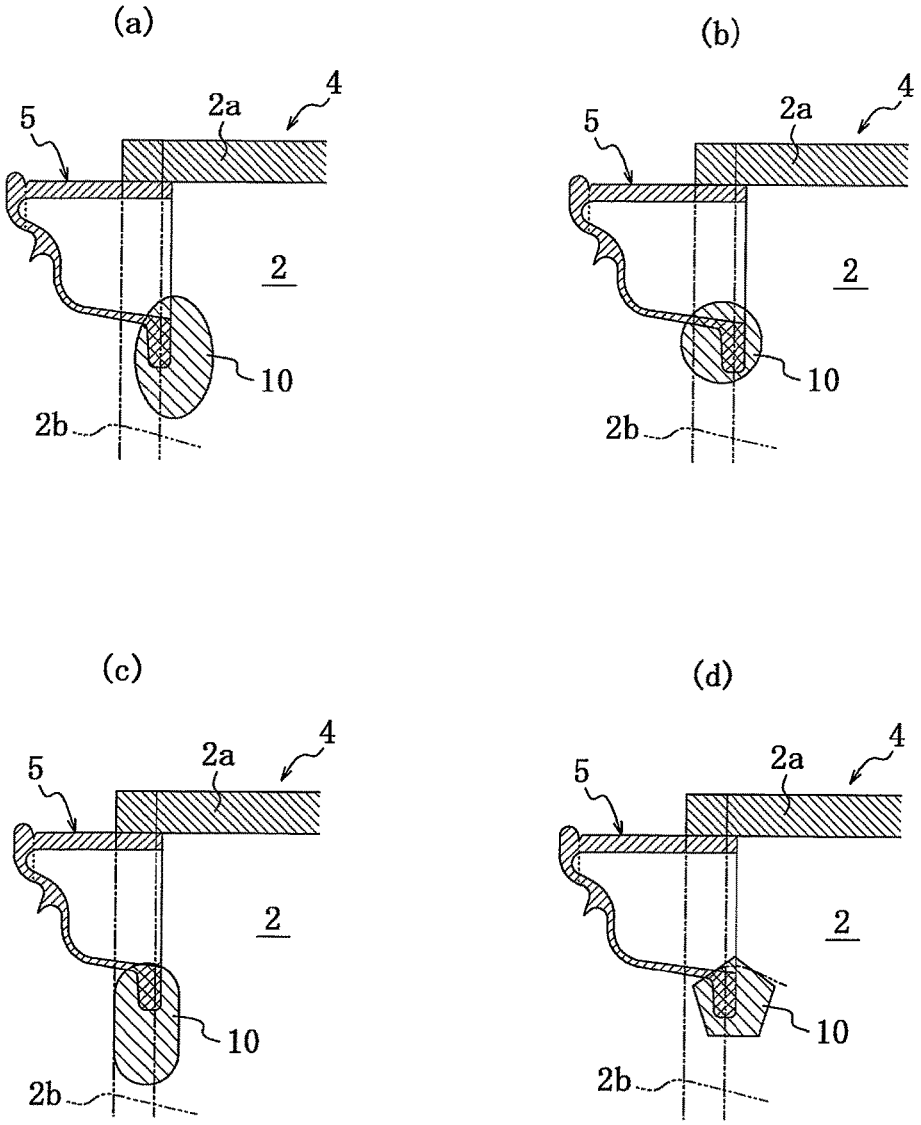
FIG. 3 is an enlarged plan view depicting a forming example of the seal for reinforcement.

In the package bag 4 mentioned above, in the case that the reinforcing seal portion 10, as shown in FIG. 3 as an example, which includes a region of the lower end of the main package bag body 2 corresponding to the base end portion of the one-way pouring nozzle 5, and, which projects toward an accommodation space 2*b* of the material to be packaged, is arranged to the sealant layer on the inner surface of the flexible main package bag body 2 to which the base end portion of the one-way pouring nozzle 5 formed by the thin and planar laminated film is fusion-joined, a stress concentration of the base end portion of the one-way pouring nozzle 5 with respect to the fusion-joined portion to the flexible main package bag body 2 can be effectively reduced by the reinforcing seal portion 10, and also a stress concentration to the fusion-joined portion around the pouring path of the one-way pouring nozzle 5 can be reduced. Therefore, a generation of the breakage to the package body due to a stacking and so on of the package bodies, in which the material to be packaged is filled and packaged, can be effectively prevented.

Here, the planar contour shape of the reinforcing seal portion 10 can be made to ellipse shape, circular shape, oval shape or polygonal shape, as shown in FIGS. 3*a* to 3*d*. In this case, whatever the planar contour shape is chosen, it is possible to sufficiently realize the desired reinforcing function with a relation to planar area. Moreover, a too much opening of the pouring path of the one-way pouring nozzle i.e. the pouring path opening can be prevented by the reinforcing seal portion 10, and thus it is possible to sufficiently remove a possibility of the detachment of the one-way pouring nozzle 5.

Since the reinforcing seal portion 10 mentioned above is formed in the region including the fusion-joined portion between the flexible main package bag body 2 and the base end portion of the one-way pouring nozzle 5, a nerve of the base end portion of the one-way pouring nozzle 5 formed by the thin laminated film becomes stronger to the same level as that of the flexible main package bag body 2. Therefore, the one-way pouring nozzle 5 is not folded from the base end portion, and thus it is possible to sufficiently maintain the pouring performance of the one-way pouring nozzle 5 as well as the self-sealing function.

Further, in the case that the planar contour shape of the reinforcing seal portion 10 is made to the polygonal shape, it is preferable to make at least corner portion of an upper end side of the package bag 4 to a convex curved shape projecting outward, as shown in FIG. 3*d* by a two-dot chain line. In this case, a flow of the material to be packaged, pouring into the pouring path of the one-way pouring nozzle 4 from a side of the flexible main package bag body 2, can be regulated, and thus it is possible to achieve a uniformizing of a pouring amount in the same manner as that of the reinforcing seal portion 10 having the planar contour shape of ellipse, circular, oval and so on.

Figure 4:
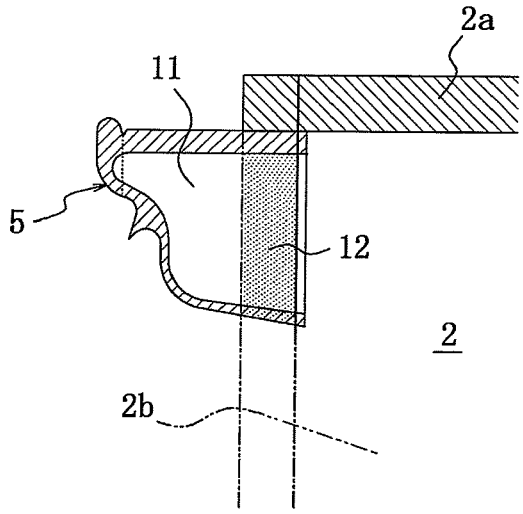
FIG. 4 is an enlarged plan view explaining the tentative fused portion.
Figure 4:
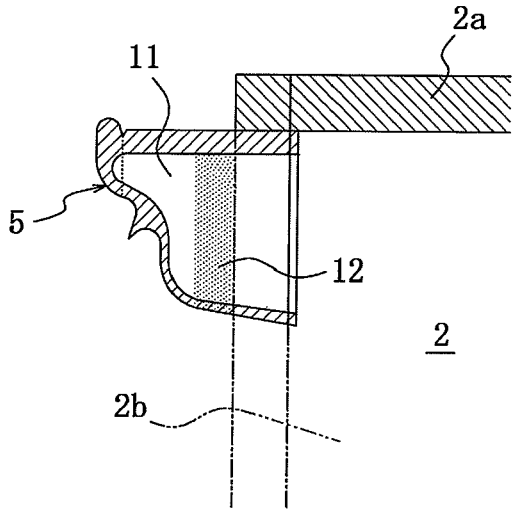

Furthermore, in the case that a tentative fused portion 12 for completely closing a pouring path 11 is arranged at the inner surface of the base end portion of the one-way pouring nozzle 5 as shown in FIG. 4 by dots, since it is possible to prevent a flow of the liquid material to be packaged, which is subjected to a high-temperature sterilization, into the pouring path 11 of the one-way pouring nozzle 5 located at a front side from the tentative fused portion 12, it is possible to effectively prevent a decrease of the self-sealing function of the one-way pouring nozzle 5 without deforming the pouring path 11 in a distended manner by means of the heated material to be packaged. In this case, the tentative fused portion 12 can be formed by making small at least one of heating temperature, applied pressure and heating duration as compared with those of the required fusion-joined portion around the pouring path 11.

In addition, since the tentative fused portion 12 exhibits anti-delamination force with respect to a stacking of the package bodies, a pressing force and so on until delaminating it non-randomly, it is effectively prevent a breakage and a distended deformation of the pouring path 11 due to a flow of the material to be packaged into the pouring path 11, and thus it is possible to sufficiently maintain the self-sealing function of the one-way pouring nozzle 5.

In the preferable embodiment, a fusion-joined strength of the tentative fused portion 12 is made to be not more than a half of the fusion strength around the pouring path 11 of the one-way pouring nozzle 5.

In this case, an unintended flow of the material to be packaged into the pouring path 11 can be prevented. In addition, in the case that the tentative fused portion 12 is non-randomly delaminated, it is possible to sufficiently eliminate a possibility of a generation of delamination and so on of the fusion-joined portion around the pouring path 11, and thus a function of the one-way pouring nozzle 5 can be realized in a desired manner.

Figure 5:
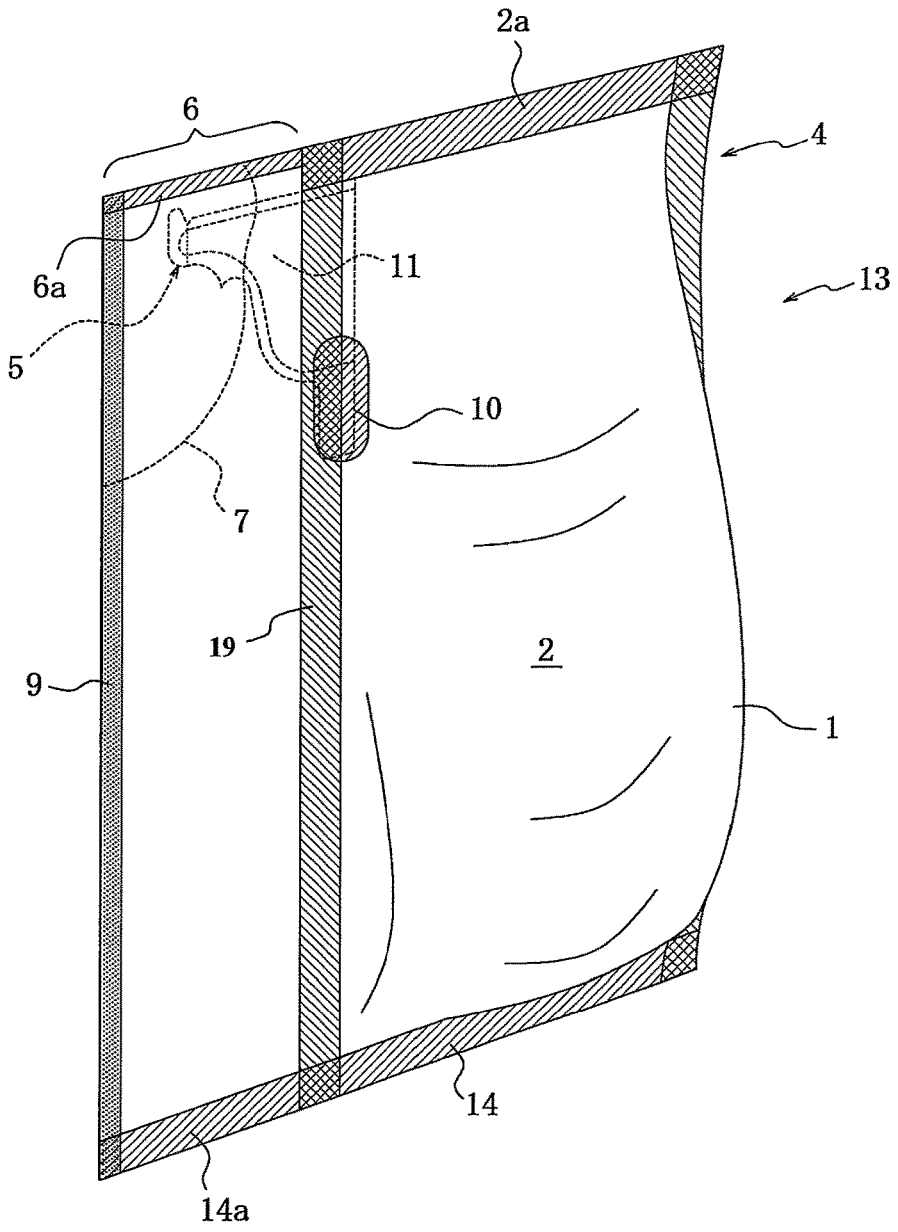
FIG. 5 is a perspective view showing one embodiment of the package body formed by filling and packaging the liquid material to be packaged into the package bag.
Figure 6:
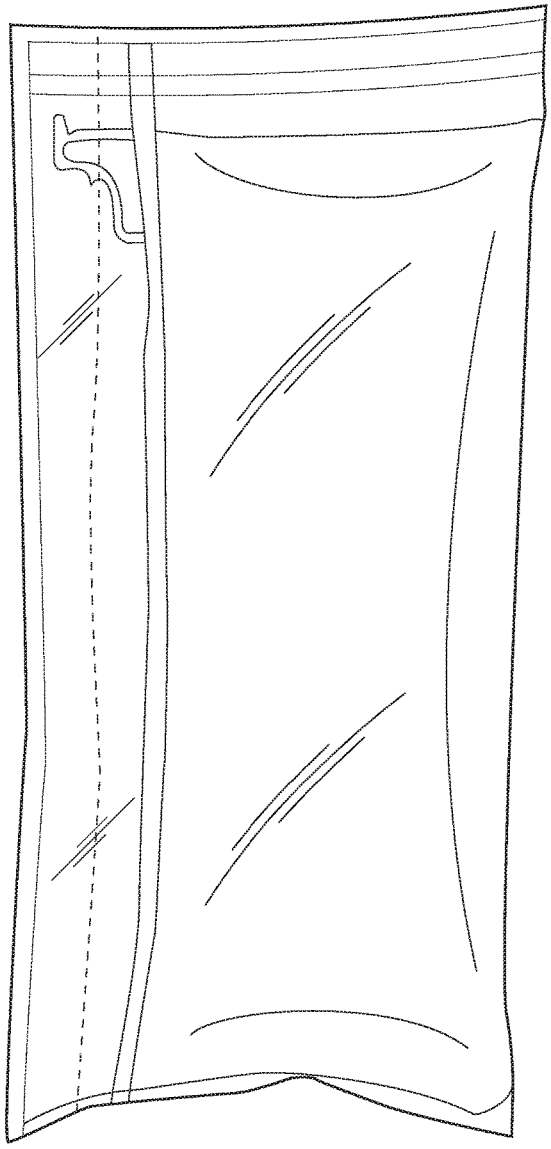
FIG. 6 is a photograph explaining the package body according to the invention.

FIG. 5 is a perspective view explaining a package body 13 according to the invention. In the package body 13 according to the invention, the liquid material to be packaged is filled from the upper opening or lower opening, in this case from the lower opening, of the package bag 4 mentioned above, and a lateral sealing portion 14 i.e. bottom sealing portion, which is formed by sealing the lower end portion of the package bag 4 in a lateral direction under no gaseous atmosphere by in-liquid seal-packing or the other method, is extended along the whole projection portion of the packaging film 1. In this case, a photograph explaining the package body 13 according to the invention is shown in FIG. 6.

The package body 13 shown in FIG. 5 does not have a self-sealing property, but it is possible to form a self-standing package body 13 by arranging a self-standing bottom portion to the package body 13.

According to the package body 13, the one-way pouring nozzle 5 is surrounded at the upper end portion of the projection portion 6 of the packaging film 1 by the fusion-joined portion 6*a* extended in a width direction of the package body 13, the fusion-joined portion 9 extended in a length direction of the package body 13 at the free end portion of the projection portion 6, and a lower fusion-joined portion 14*a* of the projection portion 6 arranged continuously to the bottom sealing portion. In addition, the both front and back surfaces of the nozzle 5 are sandwiched and positioned by the projection portion 6. Therefore, it is possible to sufficiently prevent the unintended tom-opening of the one-way pouring nozzle 5 without using an accommodation dispenser having a high stiffness and so on.

Moreover, the outward exposure of the one-way pouring nozzle 5 can be performed in an extremely easy manner by tearing and removing a tip end region of the projection portion 6 of the packaging film 1 at the formation position of the tear-inducing flaw 7.

Then, until the one-way pouring nozzle 5 is exposed outward in the manner mentioned above, it is possible to hygienically maintain the nozzle 5 by the projection portion 6 located at its both surface sides, and also it is possible to effectively protect the nozzle 5 from the permanent deformation such as bend, bulge and so on.

After the one-way pouring nozzle 5 is exposed outward, the pouring of the in-bag material to be packaged is performed by: tearing and removing the tip fusion-joined portion of the one-way pouring nozzle 5, as shown by the dotted line in figure, from for example the V notch position of the tip end portion of the one-way pouring nozzle 5; opening the pouring path 11; tilting the package body 13 in such a manner that the opening of the pouring path is directed downward under such a condition; and opening the pouring path 11 wide through the action of hydraulic head pressure of the material to be packaged.

In addition, when the pouring is performed, since the flexible main package bag body 2 is crushed and deformed by a volume corresponding to a pouring amount of the material to be packaged, it is possible to effectively prevent an air suction into the flexible main package bag body 2 during the pouring.

On the other hand, the pouring stop of the material to be packaged can be performed by returning the package body 13 to a standing position so as to firmly attach the pouring path 11 of the one-way pouring nozzle 5 immediately under an existence of thin film of the material to be packaged due to capillary phenomenon and so on, in the same manner as that of the patent documents 1 and 2. Therefore, at the pouring stop and after the pouring stop, it is possible to sufficiently prevent the air penetration into the flexible main package bag body 2, and thus it is possible to sufficiently maintain the in-bag material to be packaged from oxidation, pollution, putrefaction and so on.

In addition, it is possible to arrange the reinforcing seal portion 10 described in FIG. 3 and/or the tentative fused portion 12 described in FIG. 4 to the package body 13 shown in FIG. 5. In this case, a specific effect obtained by the reinforcing seal portion 10 and/or the tentative fused portion 12 can be sufficiently exhibited.

Here, in the package body 13 shown in FIG. 5, the fusion joined portion 6*a* extended in a width direction of the main package bag body 2 at the upper end portion of the projection portion 6, the fusion-joined portion 9 extended in a length direction of the main package bag body 2 at the free end portion of the projection portion 6 and the lower fusion-joined portion 14*a* of the projection portion 6 are not always necessary, and more than one of the fusion-joined portions can be omitted.

Then, in the package body 13 in which all the fusion-joined portions 6*a*, 9 and 14*a* are omitted, it is admitted that a constraint force of the projection portion 6 with respect to the one-way pouring nozzle 5 is decreased. However, even if the both sides of the front and back surfaces of the one-way pouring nozzle 5 are sandwiched by the projection portion 6, it is protected from the unintended tom-opening, the permanent deformation and so on.

Figure 7:
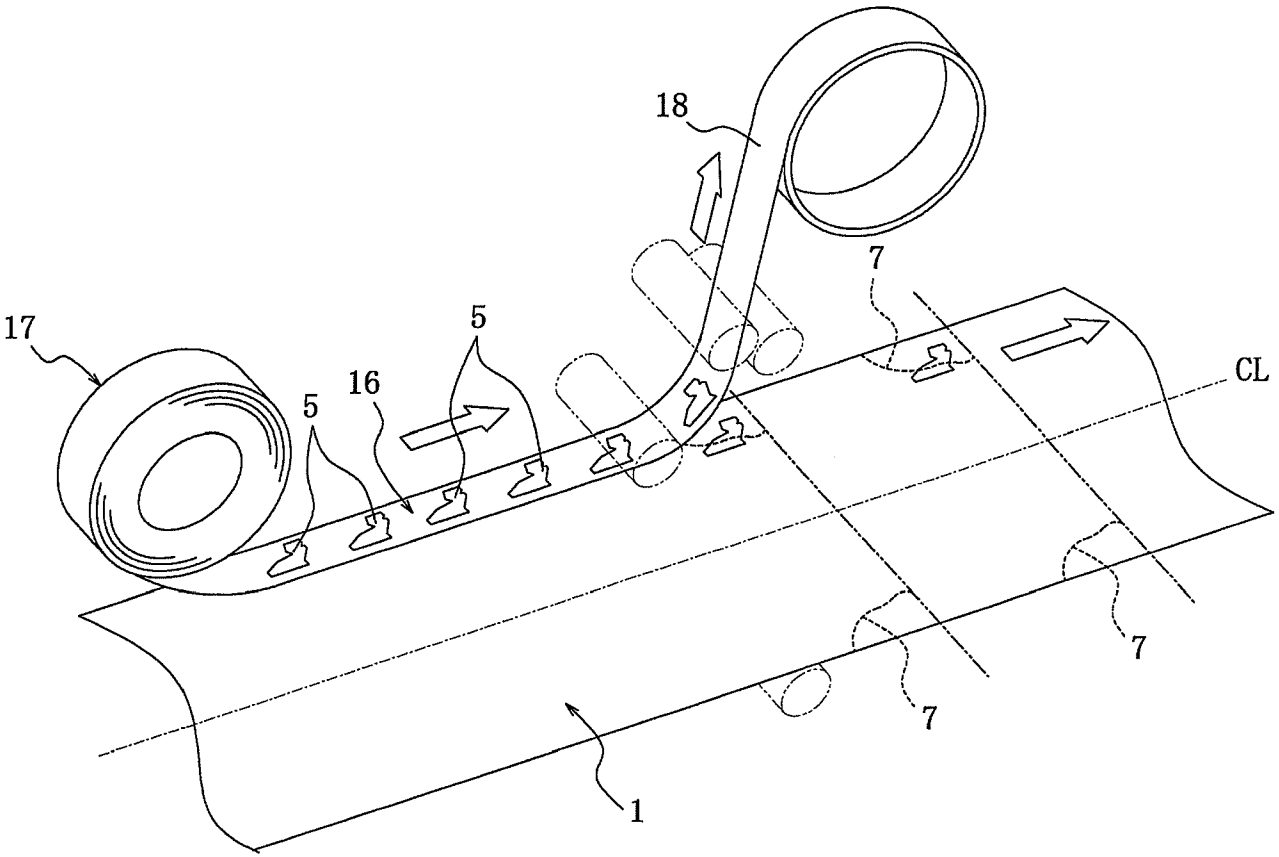
FIG. 7 is a perspective view explaining a main part of the method according to the invention.
Figure 8:
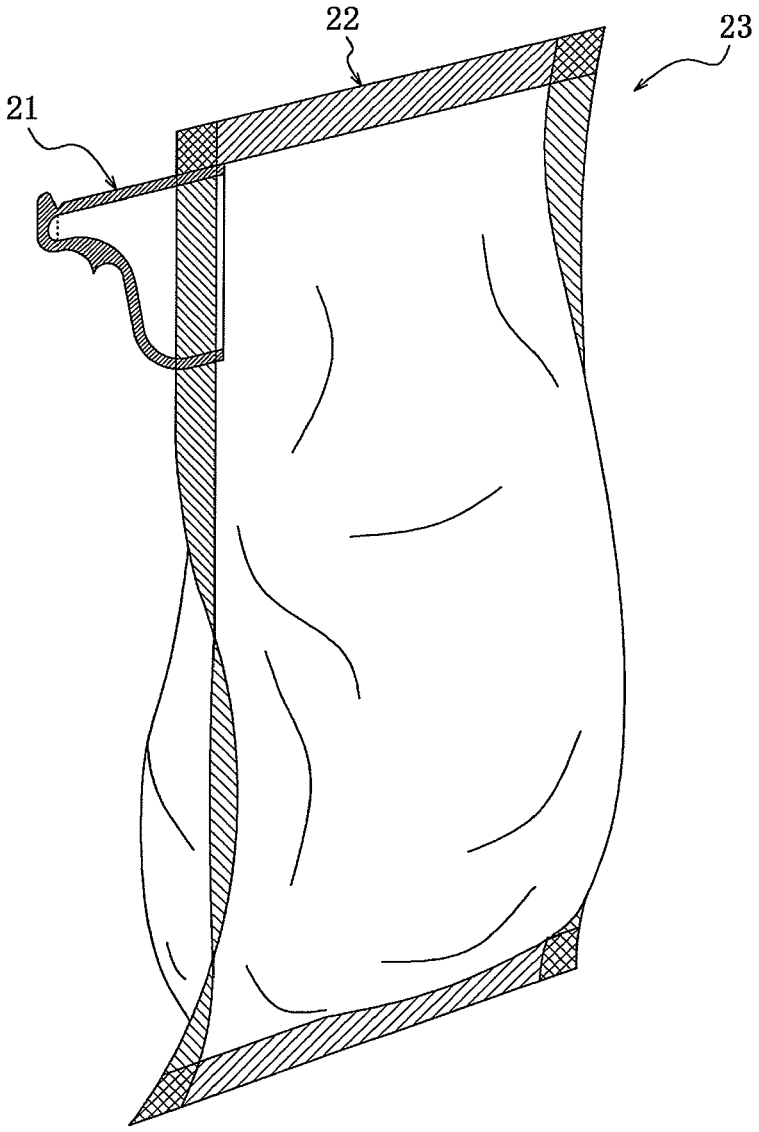
FIG. 8 is a perspective views explaining the conventional package body.
Figure 9:
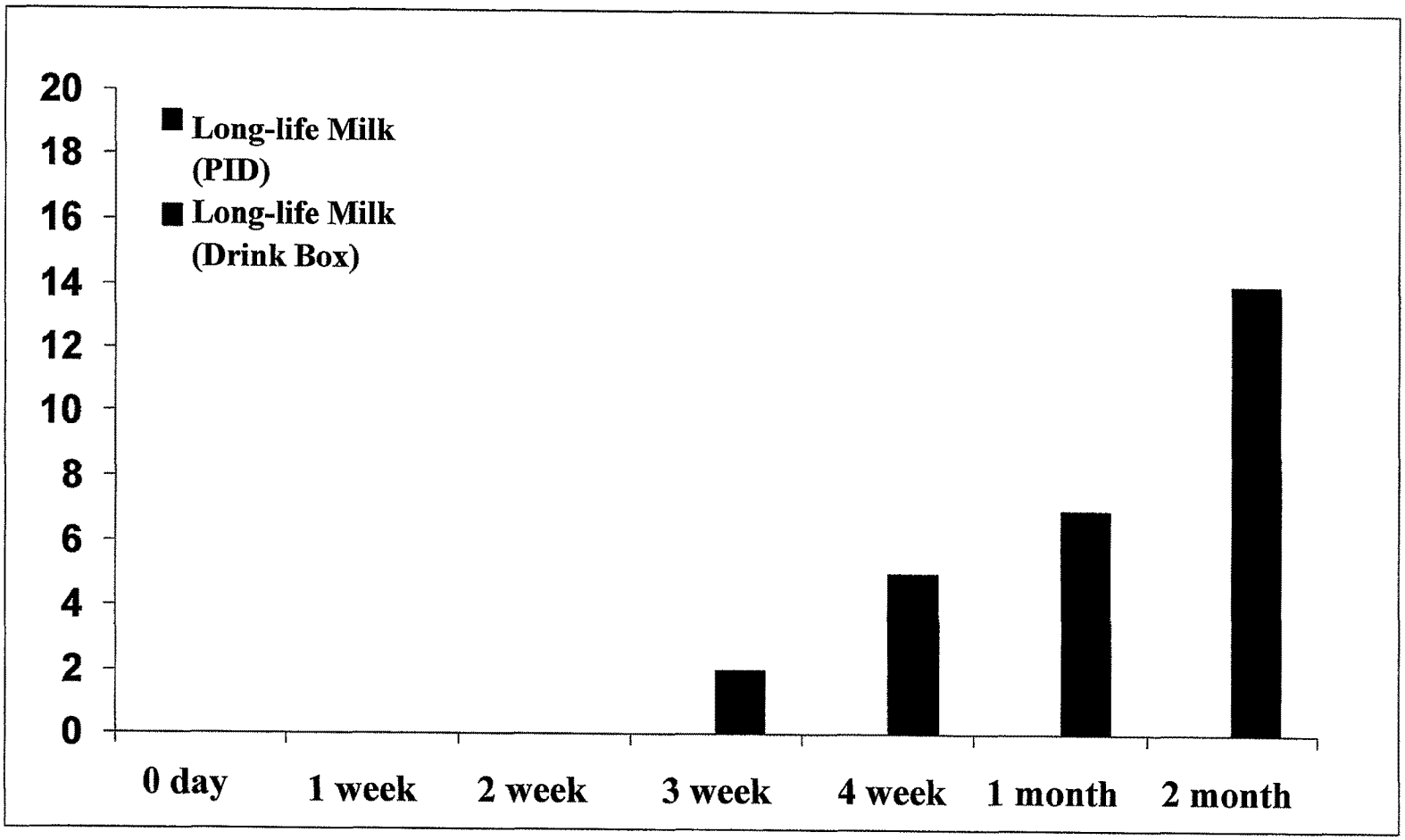
FIG. 9 is a view showing a relation between transitional period and sample numbers of microbial generation in the case of using the package bag according to the invention and a drink box respectively in which long-life milk is filled and packaged.
Figure 10:
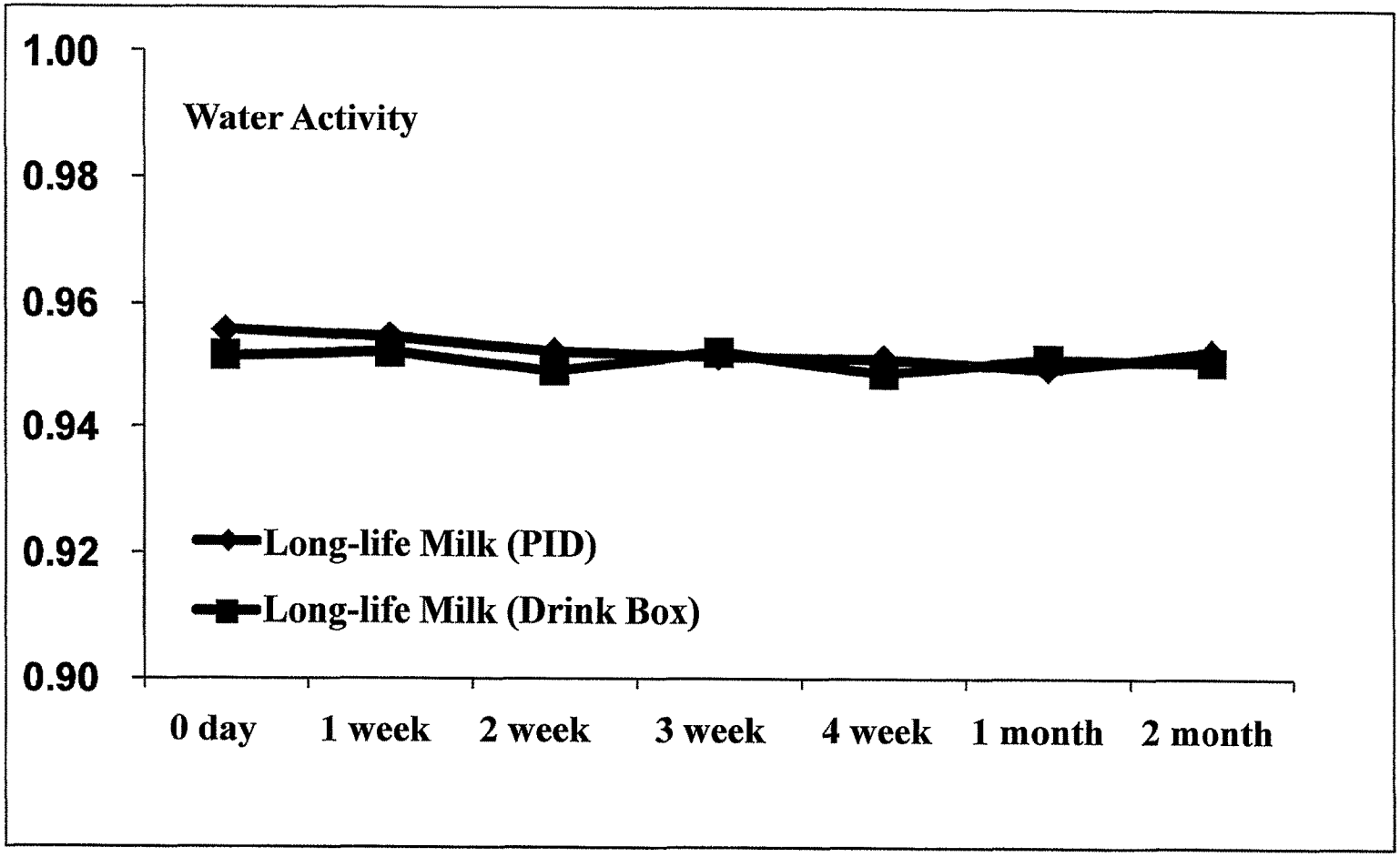
FIG. 10 is a view illustrating a change over time of water activity in the case of using the package bag according to the invention and a drink box respectively in which long-life milk is filled and packaged.
Figure 11:
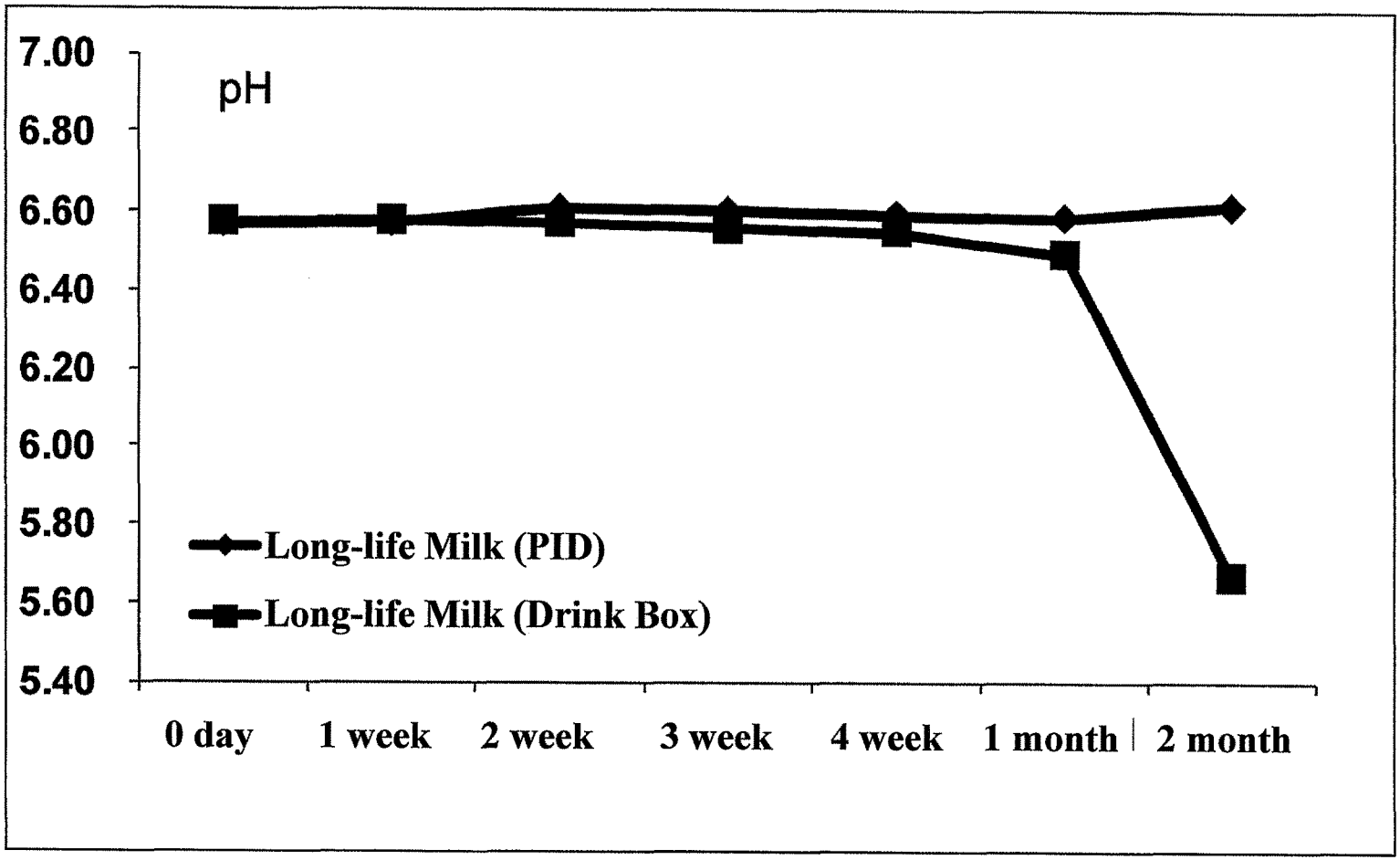
FIG. 11 is a view depicting a change over time of pH in the case of using the package bag according to the invention and a drink box respectively in which long-life milk is filled and packaged.
Figure 12:
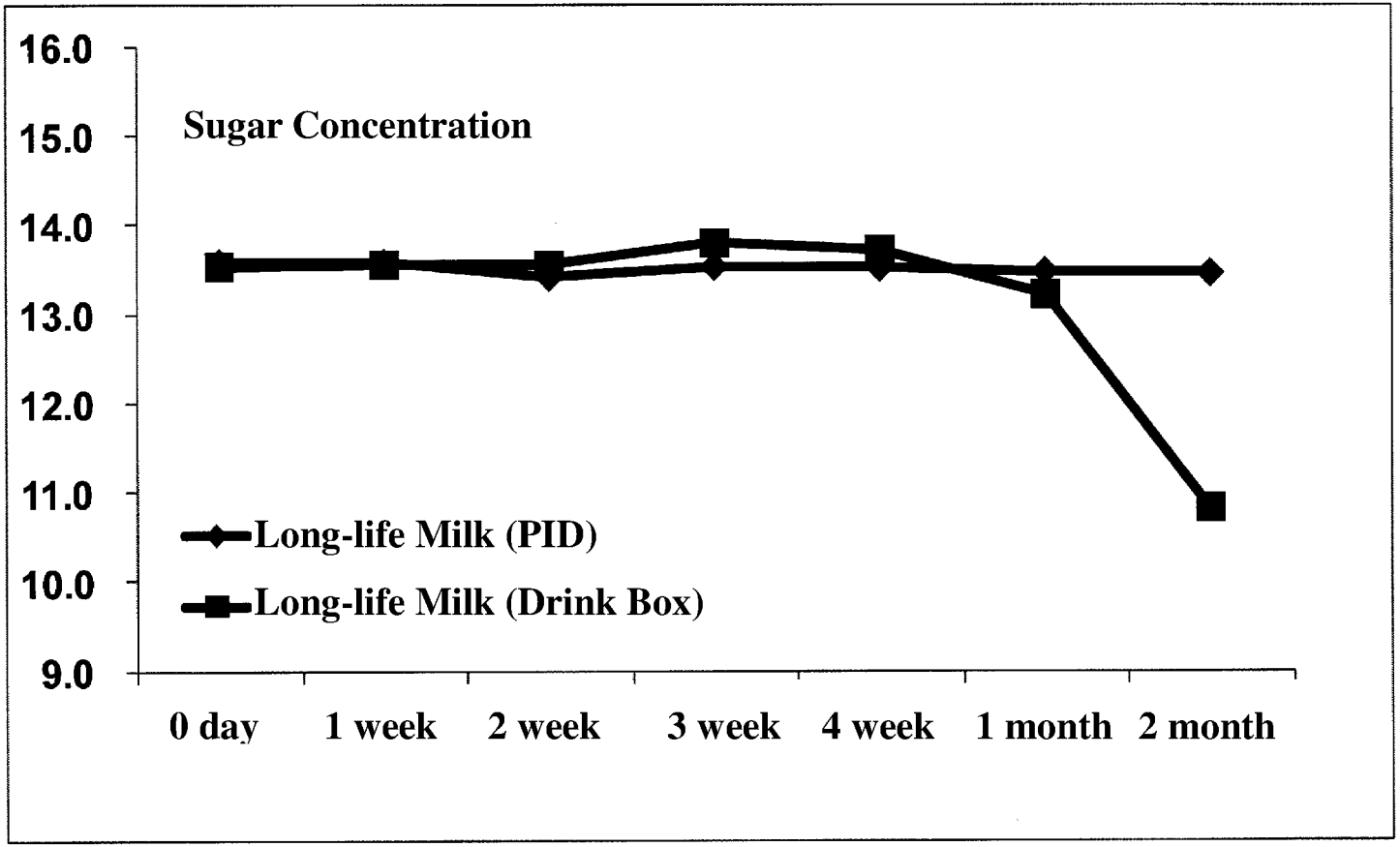
FIG. 12 is a view showing a change over time of sugar concentration in the case of using the package bag according to the invention and a drink box respectively in which long-life milk is filled and packaged.

FIG. 7 is a perspective view explaining the main part of the manufacturing method according to the invention. The manufacturing method can be performed by using for example the apparatus described in Japanese Patent Laid-Open Publication No. 2008-55739 and an existing package manufacturing apparatus.

Here, a nozzle film 16, on which a plurality of one-way pouring nozzles 5 are preliminarily formed, is fed from for example its wound roll 17 with respect to the packaging film 1 to which the tear-inducing flaw 7 is preliminarily formed and which is fed at a predetermined speed continuously or intermittently (in this case continuous moving is preferable. Then, one sealant layer on the outer surfaces of the base end portion of respective one-way pouring nozzles 5 is fusion joined to the sealant layer on the inner surface of the packaging film 1 at a position where the tear-inducing flaw 7 is passed through an intermediate portion of the one-way pouring nozzle 5, and, where tips of the one-way pouring nozzles 5 are aligned with a side end of the packaging film 1, i.e. a side end of the projection portion 6 of the packaging film 1 or tips of the one-way pouring nozzles 5 are retracted from a side end of the packaging film 1, when both films 1 and 16 are fed at a same speed. Then, an unwanted portion 18 of the nozzle film 16 is detached from the one-way pouring nozzle 5 so as to remove it. After that, the packaging film 1 is folded in half at a center portion CL of its width direction in such a manner that the sealant layers are opposed with each other. Then, the sealant layer at a folded side of the packaging film 1 is fusion-joined to the other sealant layer on the outer surface of the base end portion of the one-way pouring nozzle 5 and the packaging film 1 opposed to an extension of the base end portion of the one-way pouring nozzle 5, respectively in a longitudinal direction so as to form longitudinal sealing portions 19 constructing the flexible main package bag body 2 and in a lateral direction at a position opposed to whichever one of the lower end portion and the upper end portion of the package bag 4 to be manufactured, for example, at a position opposed to the upper end portion. In this manner, the one-way pouring nozzle 5 projected sideward from the flexible main package bag body 2 is covered at both sides of front and back surfaces at the projection portion 6 of the packaging film 1 continued from the flexible main package bag body 2 so as to manufacture the package bag 4.

Here, it is a matter of course that the formation of a plurality of one-way pouring nozzles 5 to the nozzle film 16 fed with respect to the packaging film 1 can be suitably performed by using one or two thin and planar laminated film(s) having the sealant layers on its both front and back surfaces. For example, the nozzle film 16 is constructed in such a manner that the inner surfaces of one laminated film folded in half of its width direction are fusion joined with each other by means of a heat seal and so on at a portion around the required pouring path 11 of the one-way pouring nozzle 5 and the tear-inducing flaw corresponding to the required outer contour shape of the one-way pouring nozzle 5 is formed around the thus formed fusion-joined portion. In this case, a plurality of one-way pouring nozzles 5 can be formed easily to the nozzle film 16 by using a step of folding the laminated film in a center folding state and winding it and a step of successively performing a required fusion-joining process and a required tear-inducing flaw forming process while feeding the laminated film from the wound roll.

Moreover, the fusion-joining process of one sealant layer on the outer surface of the base end portion of the one-way pouring nozzle 5 with respect to the sealant layer on the inner surface of the packaging film 1 can be performed in such a manner that, for example, a feeding and moving speed of the nozzle film 16 is accelerated on the basis of a lateral sealing signal or a signal of a register mark sensor, the one-way pouring nozzle 5 is fusion-joined to the packaging film 1 when the feeding and moving speed of the nozzle film becomes equal to that of the packaging film 1, and the feeding and moving speed of the nozzle film 16 is decelerated to a setting speed after the fusion-joining process mentioned above.

Therefore, a control of a clearance of the fusion-joined portion with respect to the packaging film 1 of the one-way pouring nozzle 5 corresponding to a size of the package bag 4 to be manufactured can be performed in such a manner that, for example, at least one of an acceleration time and an acceleration speed until the feeding and moving speed of the nozzle film 16 becomes equal to that of the packaging film 1 is controlled and at least one of a deceleration time and a deceleration speed until the moving speed of the nozzle film 16 is decreased to the setting speed is controlled.

Then, as shown in FIG. 7 by the main part, in order to fusion-join one sealant layer on the outer surface of the base end portion of the one-way pouring nozzle 5 to the sealant layer on the inner surface of the packaging film 1, use may be made of a nozzle installation apparatus comprising: a feeding axis for supporting the wound roll 17 of the nozzle film 16, on which a plurality of one-way pouring nozzles 5 are preliminarily formed; a feed roller for drawing the nozzle film 16 from the wound roll 17 on the feeding axis at a required speed; a heat roller always contacting to a side of a base film layer of the packaging film 1 having laminated structure, which is installed in a moving path of the packaging film 1 of for example a package manufacturing apparatus; a pressing roller for joining the outer surface of the base end portion of the one-way pouring nozzle 5 to the packaging film 1 by means of the heat seal by pressing the sealant layer on the outer surface of the nozzle film 16 to the sealant layer of the packaging film 1 on the heat roller, which perform a forward and backward displacement with respect to the heat roller; a separation roller for detaching the unwanted portion 18 of the nozzle film 16 from the one-way pouring nozzle 5 after the one-way pouring nozzle 5 is heat-sealed to the packaging film 1; and a wound axis for rolling up the unwanted portion 18 of the nozzle film 16. Since the apparatus mentioned above can be made simple and compact structure, it is possible to arrange the apparatus easily to the existing package manufacturing apparatus without occupying a large space.

Meanwhile, in the case that one sealant layer on the outer surface of the base end portion of the one-way pouring nozzle 5 is fusion-joined to the sealant layer on the inner surface of the packaging film 1 by means of the heat seal and so on according to the method shown in FIG. 7 by the main part, it is possible to fusion-join the sealant layer of the one-way pouring nozzle 5 to the packaging film 1 only at the intermediate portion in a moving direction of the packaging film 1. In this case, it is possible to realize the fusion-joined portion for sufficiently maintaining the required liquid-tight property even at the remaining portion of one sealant layer of the one-way pouring nozzle 5, if the other sealant layer on the outer surface of the base end portion of the one-way pouring nozzle 5 is fusion-joined to the sealant layer at the folded side of the packaging film 1.

Embodiment

Example 1

The following examination was performed as to bacteria-proof and antibacterial effects on the basis of the self-sealing function of the one-way pouring nozzle.

Meanwhile, as the material to be packaged, use was made of long-life milk (Maker: AEON Co., Ltd., Sterilizing method: 140° C., 2 seconds sterilization), and, as the package bag, use was made of the bag of 200 ml size (to which gamma-ray was irradiated) in which the one-way pouring nozzle mentioned above was projected, so as to form one sample. In this case, 20 samples were prepared. Moreover, the package bag used in this example was formed by the laminated film made of nozzle: PE 15 μm/PET 12 μm/PE 25 μm and main package bag body: NY 15 μm/PE 50 μm.

At first, 200 ml of long-life milk was filled and packaged into respective package bags (20 samples) aseptically in a clean bench. After that, the nozzle tip was opened in a room so as to open the pouring path, and 5 ml of the material to be packaged (milk) was poured again at every one week. Then, whether or not microbe was existent in the material to be packaged was estimated by means of a pour plate culture using a standard agar medium.

Meanwhile, respective package bags were preserved at a room temperature (25° C.), and the examination mentioned above was performed for two months. Moreover, water activity, pH and sugar concentration were estimated. Further, as a comparative example, 20 samples of drink boxes, in which 200 ml of long-life milk was filled and packaged, were prepared.

The results were shown in FIG. 9 to FIG. 12. According to the results shown in FIG. 9, it was understood that, in the package bag in which the one-way pouring nozzle was arranged as a projection, microbe was not generated in the material to be packaged (milk) even after a lapse of two weeks in spite of pouring the material to be packaged with time (every one week) after opening the pouring path, and also the air penetration into the package bag was not detected. Therefore, it was confirmed that the one-way effect due to the one-way pouring nozzle having the self-sealing function could be exhibited effectively.

On the other hand, in the case that the material to be packaged was preserved in the drink box, it was confirmed that microbe was generated after three weeks from the pouring start, and, after that, microbe was grown continuously.

Moreover, as to the water activity, pH and the sugar concentration (FIG. 10 to FIG. 12), in the package bag in which the one-way pouring nozzle was arranged as a projection, a variation was not detected almost after a lapse of two months, and also deterioration in quality was not recognized. Contrary to this, in the case that the material to be packaged was preserved in the drink box as the comparative example, pH was changed to an acid side, the sugar concentration was decreased after one month from the pouring start, and deterioration in quality was recognized.

Example 2

Figure 13:
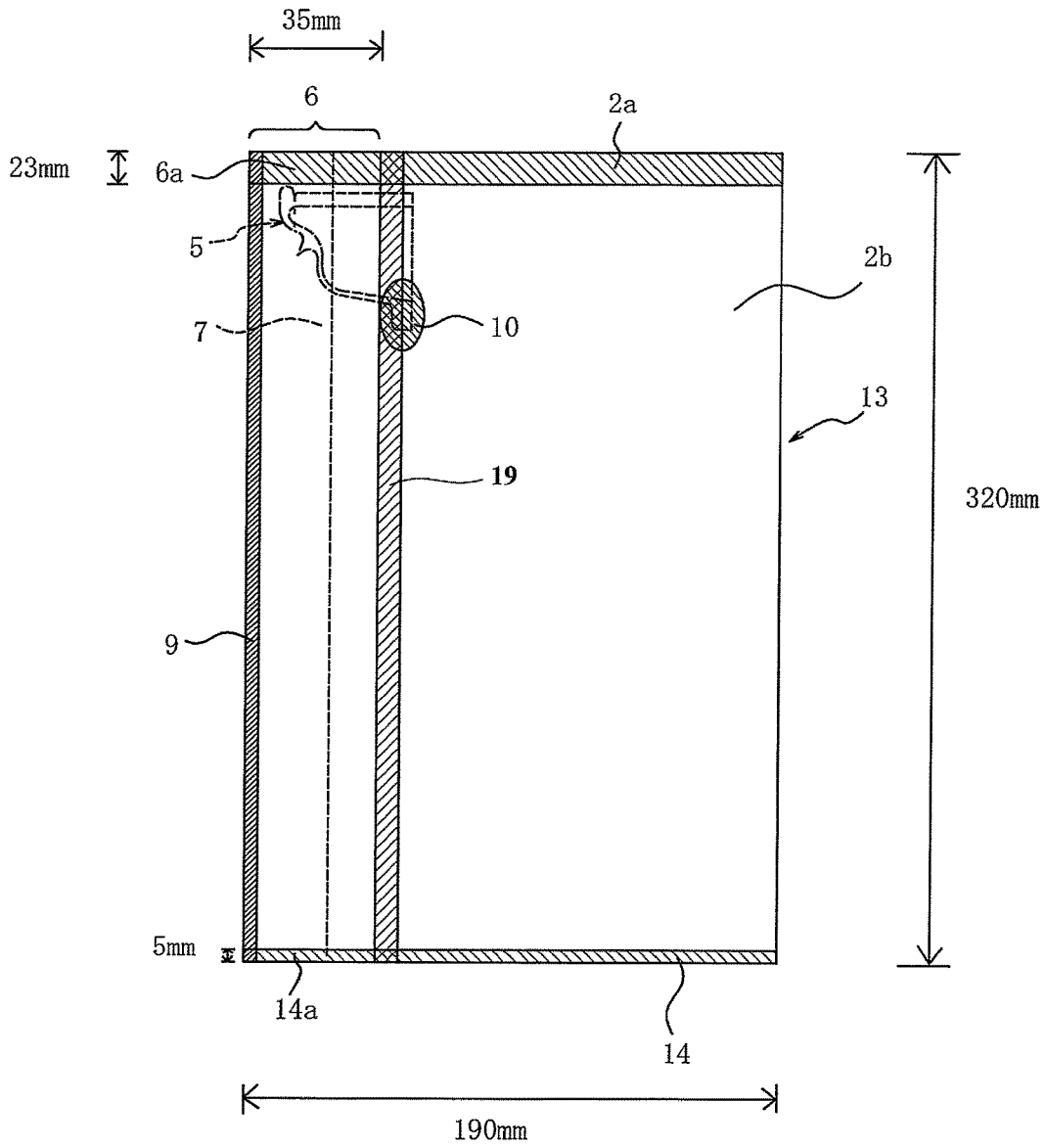
FIG. 13 is a view illustrating a dimension of the package bag used in the embodiment 2.

It was confirmed that the package body, in which 1000 ml of water was filled and packaged in the package bag having a dimension shown in FIG. 13 which was formed by the film structure of one-way pouring nozzle: PE 15 μm/PET 12 μm/PE 25 μm and main package bag body: NY 15 μm/PE 50 μm, had a bag breaking strength which was sufficient for practical use.

At first, the accommodation space 2*b* of water was pressed for two minutes under a load of 800 N. After that, a withstanding pressure of the package body 13 was measured under such a condition that the load was increased by every 100 N. As a result, the average withstanding pressure of ten package bodies 13 was 1400 N, and a broken position was a portion near the lower end of the projection portion from the main package bag body 2.

Then, a bag breaking height, in the case that ten package bodies 13 were subjected to a free fall from 60 cm height which was increase by every 20 cm, was measured. As a result, the average bag breaking height was 180 cm.

Meanwhile, a broken position was a portion near the lower end of the projection from the main package bag body 2 of the one-way pouring nozzle 5 in the same manner as that of the withstanding pressure mentioned above.

INDUSTRIAL APPLICABILITY

The package bag according to the invention is not limited to the embodiments shown in figures, but can vary the structures partially. Therefore, the package bag according to the invention can be used as the package bag for: thick substances such as mayonnaise, cosmetics; drugs and medicines and so on; other than seasoned liquid such as soy sauce, dressing and so on; various types of beverages.

EXPLANATION OF SYMBOL

1 packaging film
2 flexible main package bag body
2*a* lateral sealing portion
2*b* accommodation space
3 lower end opening
4 package bag
5 one-way pouring nozzle
6 projection portion
6*a* fusion-joined portion
7 tear-inducing flaw
8 lateral fused portion
9 fusion-joined portion
10 reinforcing seal portion
11 pouring path
12 tentative fused portion
13 package body
14 lateral sealing portion
14*a* lower end fusion-joined portion

16 nozzle film
17 wound roll
18 unwanted portion
19 longitudinal sealing portion
CL center portion

The invention claimed is:

1. A package bag having: a flexible main package bag body formed by fusion-joining a sealant layer of a packaging film of laminated structure including a base film layer and the sealant layer; and a one-way pouring nozzle having a self-sealing function formed by fusion-joining a portion around a pouring path of in-bag material to be packaged without a base end side, which is constructed by a planar laminated film having thin thickness comprising sealant layers on front-back both sides, wherein the one-way pouring nozzle is projected laterally from a side portion of the flexible main package bag body at an upper portion or a lower portion of the flexible main package bag body by fusion-joining an outer surface of a base end portion of the one-way pouring nozzle to the sealant layer existing on an inner surface of the side portion of the main package bag body, comprising:

a projection portion of the packaging film extending continuously from front and back portions of the packaging film of the flexible main package bag body side portion, with which the whole one-way pouring nozzle is covered from both of a front surface side and a back surface side; and a tear-inducing flaw extending along a projection direction of the projection portion from the flexible main package bag body, the tear-inducing flaw positioned crossing the center in the projection direction of the one-way pouring nozzle, wherein the main package bag body is made to be opened at either one side of an upper end and a lower end.

2. The package bag according to claim 1, wherein the sealant layers on the opposed inner surfaces of the packaging film are fusion-joined with each other in an up-and-down direction of the main package bag body at a free end portion of the projection portion of the packaging film.

3. The package bag according to claim 1, wherein the tear-inducing flaw is formed in a linear shape or a curved shape at its overlapping region with the one-way pouring nozzle.

4. The package bag according to claim 1, wherein a tentative fused portion for completely closing the pouring path is arranged at the inner surface of the base end portion of the one-way pouring nozzle.

5. A package body, wherein a liquid material to be packaged is filled from the upper opening of the package bag set forth in claim 1, the upper end portion or the lower end portion is sealed in a lateral direction under no gaseous atmosphere, and the thus formed lateral sealing portion is extended along whole projection portion of the packaging film.

6. The package bag according to claim 1, wherein the sealant layers on the opposed inner surfaces of the projection portion of the packaging film are fusion-joined with each other in a width direction of the main package bag body at a vicinity of the one-way pouring nozzle.

7. The package bag according to claim 6, wherein a fusion-joining portion of the projection portion of the packaging film extending in a width direction of the main package bag body is formed continuously to a traverse seal portion at the upper end portion or the lower end portion of the main package bag body.

8. The package bag according to claim 6, wherein a fusion-joining portion of the projection portion of the packaging film extending in a width direction of the main package bag body is formed on an extended line of a fused portion extending parallel to the upper end portion or the lower end portion of the main package bag body.

9. The package bag according to claim 1, wherein a reinforcing seal portion, which includes a region of the lower end of the main package bag body corresponding to the base end portion of the one-way pouring nozzle, and, which projects toward a storage space of the material to be packaged, is arranged to the inner surface of the main package bag body to which the base end portion of the one-way pouring nozzle is fusion-joined.

10. The package bag according to claim 9, wherein a planar contour shape of the reinforcing seal portion is circular shape, ellipse shape, oval shape or polygonal shape.

11. The package bag according to claim 10, wherein at least corner portion of the reinforcing seal portion having polygonal shape as its planar contour shape, which exists at an upper end side of the package bag, is a convex curved shape projecting outward.

12. A method of manufacturing the package bag set forth in claim 1, comprising:

feeding a nozzle film, on which a plurality of one-way pouring nozzles are preliminarily formed, with respect to the packaging film to which the tear-inducing flaw is preliminarily formed and which is fed at a predetermined speed;

fusion-joining one sealant layer on the outer surfaces of the base end portion of respective one-way pouring nozzles to the sealant layer on the inner surface of the packaging film at a position where the tear-inducing flaw is passed through an intermediate portion of the one-way pouring nozzle, and, where tips of the one-way pouring nozzles are aligned with a side end of the packaging film or tips of the one-way pouring nozzles are retracted from a side end of the packaging film, when both films are fed at a same speed;

detaching an unwanted portion of the nozzle film from the one-way pouring nozzle so as to remove it;

folding the packaging film in half at a center portion of its width direction; and fusion-joining the sealant layer at a folded side of the packaging film to the other sealant layer on the outer surface of the base end portion of the one-way pouring nozzle and the packaging film opposed to an extension of the base end portion of the one-way pouring nozzle, respectively in a longitudinal direction so as to form the package bag and in a lateral direction at a position opposed to whichever one of the lower end portion and the upper end portion of the package bag to be manufactured, so that the one-way pouring nozzle projected sideward from the main package bag body is covered at both sides of front and back surfaces at the projection portion of the packaging film continued from the main package bag body.

* * * * *